US007610854B2

(12) United States Patent
Wattyn

(10) Patent No.: US 7,610,854 B2
(45) Date of Patent: Nov. 3, 2009

(54) IMAGING SYSTEM AND METHOD FOR LOADING A PRINTING PLATE

(75) Inventor: Bart Marc Luc Wattyn, Dentergem (BE)

(73) Assignee: Punch Graphix International N.V., Lier (BE)

( * ) Notice: Subject to any disclaimer, the term of this patent is extended or adjusted under 35 U.S.C. 154(b) by 226 days.

(21) Appl. No.: 11/542,490

(22) Filed: Oct. 3, 2006

(65) Prior Publication Data

US 2007/0084374 A1 Apr. 19, 2007

(30) Foreign Application Priority Data

Oct. 4, 2005 (EP) ..... 05077248

(51) Int. Cl.
*B41F 27/12* (2006.01)
*B41F 1/28* (2006.01)
*B41C 3/08* (2006.01)

(52) U.S. Cl. ..... 101/477; 101/401.1; 101/474

(58) Field of Classification Search ..... 101/477, 101/401.1, 407.1, 474; 271/11, 264, 267
See application file for complete search history.

(56) References Cited

U.S. PATENT DOCUMENTS 4,178,097 A * 12/1979 Sara ..... 355/100
4,660,959 A * 4/1987 Schoen ..... 399/166
7,363,856 B1 * 4/2008 Moulin ..... 101/467
2005/0132916 A1 6/2005 Behrens

FOREIGN PATENT DOCUMENTS

| | | | |
|---|---|---|---|
| DE | 38 28 439 | A1 | 3/1990 |
| EP | 1 473 153 | A2 | 11/2004 |
| WO | WO 00/49463 | A | 8/2000 |

* cited by examiner

*Primary Examiner*—Ren Yan
(74) *Attorney, Agent, or Firm*—Quarles & Brady LLP

(57) ABSTRACT

An imaging system for performing a computer-to-plate imaging process on printing plates includes a plate imaging bed for exposing radiation to a printing plate. The bed includes an input section for receiving a printing plate and an output section for transferring the printing plate to a chemical processing unit. The system further comprises a loading device for loading the printing plate from a multiple plate stack to the input section of the plate imaging bed. The input section is adjustable with respect to the output section to adjust the position of the input section to near the top of the multiple plate stack. The latter is accomplished in a preferred embodiment by providing the plate imaging bed with a pivot axle near the output section.

11 Claims, 3 Drawing Sheets

IMAGING SYSTEM AND METHOD FOR LOADING A PRINTING PLATE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to an imaging system and a method for loading a printing plate. Traditionally, a prepress process requires the development of a negative or positive film of data to be printed. The film is subsequently copied onto a printing plate. Then, the printing plate is employed for offset printing activities. The computer-to-plate imaging process comprises a digital technology transferring text and/or images directly onto the printing plate by means of an radiation exposure unit. Thereby the intermediate film production is bypassed.

A known imaging system for performing a computer-to-plate imaging process on printing plates comprises a plate imaging bed for exposing radiation to a printing plate, the bed being provided with an input section for receiving a printing plate and an output section for transferring the printing plate to a chemical processing unit. In operation, a loading device loads a printing plate from a multiple plate stack to the input section of the plate imaging bed.

Such an imaging system is known. The printing plate comprises a support substrate that can be metal or polymer based. Popular metal supports are aluminum based. Other metal supports comprise copper and/or steel, but polymer supports as used in flexography and polyester based plates are also possible. On this substrate, a radiation sensitive coating is provided which can easily be damaged during handling. In an initial stage, the printing plate is stacked together with a multiple set of printing plates on a multiple plate stack. During the process, individual printing plates are loaded from the stack towards the input section of the plate imaging bed by means of the loading device. Subsequently, the printing plate is locally sensitized by radiation that is exposed by the imaging system and transported to the end section of the printing plate. Then, the printing plate is transferred to art optional external conveyor system or a chemical processing unit, for plate types that require chemical processing. The conveyor or chemical processing unit is positioned adjacent the output section of the imaging bed for optional further processing.

The multiple plate stack is supported by a supporting unit, such as a cassette. In a conventional imaging system, the height of the cassette is adjustable, so that the height of the upper plate of the stack can be kept at a desired level, thus facilitating the transfer of an upper printing plate from the stack to the imaging bed without being damaged. Further, the lower level of the stack is fixed while the loading device is movable in the vertical direction, so that an upper printing plate can be lifted from the stack and can be brought to a desired level corresponding to the height of the imaging bed.

A disadvantage of such a loading mechanism is its complexity, causing time loss and/or increased costs. Further, the known loading mechanism is in general only suitable for handling printing plates in a specific configuration of imaging bed and stack structure.

In practice, two or more plate stacks can be positioned near the input section of the imaging bed. A further disadvantage is, that this further increases the complexity of the height adjusting mechanisms.

Comparable handling systems are known from patent publication EP 1 473 153, wherein a flexographic plate is exposed to e.g. ultra violet light.

BRIEF SUMMARY OF THE INVENTION

It is an object of the invention to provide an imaging system, wherein the disadvantages identified above are reduced. In particular, the invention aims at obtaining an imaging system which is more flexible with respect to multiple plate stacks. Thereto, according to an aspect of the invention, the input section is adjustable with respect to the output section to adjust the position of the input section to near the top of the multiple plate stack.

By adjusting the position of the input section to near the top of the multiple plate stack, an imaging system is obtained wherein the loading device can easily transfer an upper printing plate from the stack towards the input section of the imaging bed. As a consequence, the imaging system is more flexible with respect to multiple plate stacks. By rendering the input section adjustable with respect to the output section, the position of the output section can be maintained, an optimal transfer of the printing plate towards the chemical processing unit is maintained.

During the loading process of subsequent printing plates, the input section can follow the top of the stack, thereby minimizing the transfer distance of the printing plate. Also, stacks having different stack heights can thus be processed.

Moreover, the system according to the invention is also more suitable with respect to various types of stacks, such as different cassette types, multiple cassettes and/or Euro-pallets. As an example, the input section can be set from near the top of a first stack to near the top of a second stack. Further, the chance that printing plates are damaged during the transfer from the stack to the input section of the imaging bed is even reduced, as the transport distance of the printing plate from the stack to the input section is minimal during transfer.

It is noted that in this context the expression 'top of the stack' means the position of a printing plate that delimits the stack. Similarly, with this context the expression 'stack height' denotes the size of the multiple plate stack in a direction wherein the stack increases or decreases during loading and unloading, respectively, of the stack. If the stack has been loaded in a vertical direction, the top of the stack is the height of the upper printing plate.

By providing the plate imaging bed with a pivot axle for pivoting the plate imaging bed, relative good control over adjustments of the input section position can be obtained. In a preferred embodiment, the pivot axle is arranged near the output section, so that the effect of the input section position on the output section position is mainly negligible, so that good transferring conditions for transferring the printing plate towards the chemical processing unit are provided.

Advantageously, the plate imaging bed forms a stiff lever arm, so that the imaging bed and also the printing plate being processed remains substantially flat, thereby facilitating good exposure conditions.

Other advantageous embodiments according to the invention are described in the following claims.

BRIEF DESCRIPTION OF THE SEVERAL VIEWS OF THE DRAWINGS

By way of example only, embodiments of the present invention will now be described with reference to the accompanying figures in which.

The figures are merely schematic views of preferred embodiments according to the invention. In the figures, the same reference numbers refer to equal or corresponding parts.

DETAILED DESCRIPTION OF THE INVENTION

Figure 1:
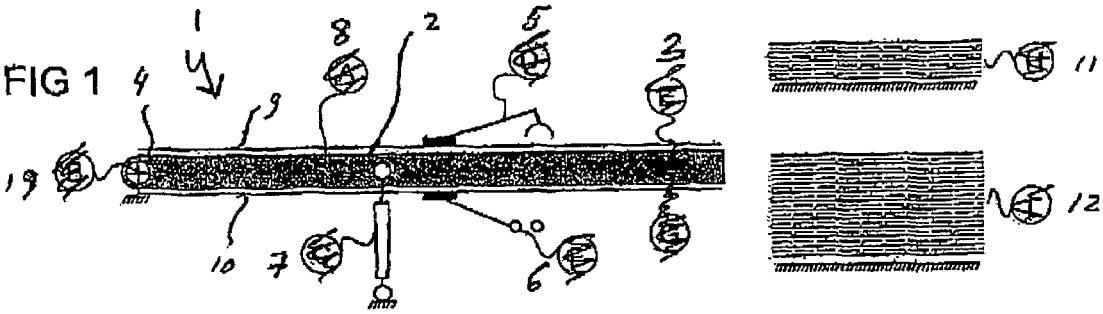
FIG. 1 shows a schematic side view of an imaging system according to the invention.

FIG. 1 shows a schematic side view of an imaging system 1 according to the invention. The imaging system 1 comprises a plate imaging bed 2 having an input section 3 and an output section 4. During a computer-to-plate imaging process, printing plates are transferred from a multiple plate stack 11, 12 to the input section 3, as will be explained in more detail below. Subsequently, the printing plate is exposed to radiation from a radiation exposure unit (not shown) that is mounted on the plate imaging process and that can comprise an imaging array or a scanning beam based exposure system such as a rotating polygon laser module. Then, the printing plate is transported to the output section 4 and transferred to a chemical processing unit (also not shown) that is placed near the output section 4.

Further, the imaging system 1 is provided with a loading device comprising a printing plate loader 5 and a paper gripper 6 for loading a printing plate from a stack to the imaging bed. The printing plate loader is arranged to transfer a printing plate from the stack 11, 12 to the input section 3, while the paper gripper 6 is adapted to remove an interleave paper that is positioned between subsequent printing plates on the stack 11, 12. By providing a loader 5 for transferring printing plates, and a paper gripper 6 for removing interleave papers, both devices can advantageously be optimized for performing their specific task. In a more basic embodiment, the loader 5 and the gripper 6 are integrated in a single device. In a preferred embodiment, the printing plate loader 5 comprises a vacuum loader. However, other devices are also possible, such as a gripping element. The gripper 6 comprises gripping elements 15.

Both the loader 5 and the gripper 6 are movable along the plate imaging bed 2 by means of separate upper and lower rails 9, 10, respectively, so that printing plates and interleave papers can be pulled from the stack 11, 12. In another embodiment, the loader 5 and the gripper 6 are placed on common rails. Further, the rails 9, 10 can be replaced by other guiding means, such as V-profiles.

The imaging bed 2 is provided with a pivot axle 19 near the output section 4 to facilitate a pivotal movement of the bed 2 with respect to an axis extending through the axle 19. The pivot axle 19 is e.g. supported by two bearings. The pivotal movement of the bed can be performed in a plane that is oriented transverse to the bed 2, so that the input section 3 can be adjusted to the top of a stack 11, 12. The bed 2 comprises a bed carrier 8 providing a stiff structure. As a consequence, the plate imaging bed 2 forms a relative stiff lever arm that is pivotable with respect to the pivot axle 19. The height of the pivot axle is preferably fixed, e.g. at a height of circa 915 mm, in order to provide good transferring conditions for transferring a printing plate to the chemical processing unit.

Further, the imaging system 1 comprises a position adjusting device 7 engaging the plate imaging bed 2 remote from the pivoting axle 19 for positioning the input section 3 near the top of the multiple plate stack. In the position adjusting device as shown in FIG. 1, the position adjusting device 7 comprises an actuator mechanism, such as a lead screw with a motor, a hydraulic cylinder, an air cylinder, a linear motor, a belt and motor based or a chain and motor based actuator.

Movement of a printing plate from the input section 3 towards the output section 4 of the bed 2 can be controlled by means of a moving bed unit. However, also other movement control systems can be employed, such as a guiding unit comprising a pair of cylinders each contacting an opposite side, respectively, of the printing plate.

Figure 2:
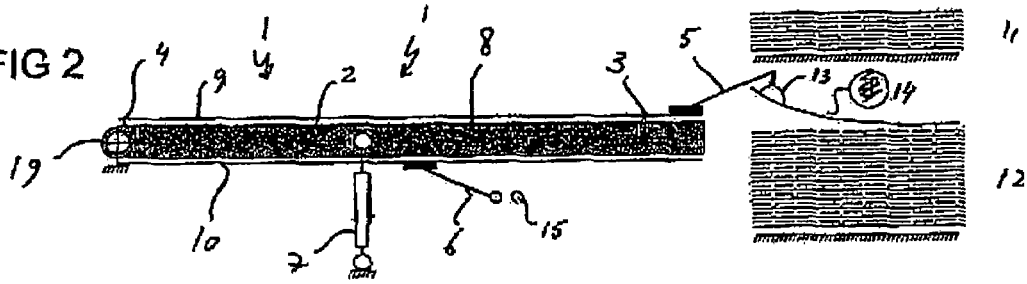
FIG. 2 shows a schematic side view of the imaging system of FIG. 1 during a first stage of a loading process.

In FIG. 2 a schematic side view of the imaging system 1 during a first stage of a loading process is shown. The printing plate loader 5 moves via the upper rails 9 along the bed 2 towards a first stack 12. The stack 12 comprises multiple printing plates wherein between each two printing plates an interleave paper is positioned to avoid damage on the structure of the printing plates. The printing plates comprise a support substrate that can be metal or polymer based. Popular metal supports are aluminum based. Other metal supports include copper and/or steel. Polymer supports as used in flexography and polyester based plates are also possible. At least one radiation sensitive layer is coated on the support. The stack 12 is supported by a cassette or a Euro-pallet. In FIG. 2, the loader 5 lifts an upper printing plate 14 up from an interleave paper.

Figure 3:
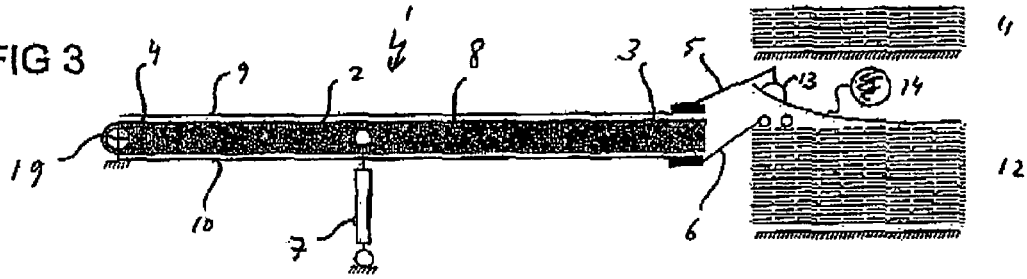
FIG. 3 shows a schematic side view of the imaging system of FIG. 1 during a second stage of a loading process.

During a second stage of the loading process, as shown in FIG. 3, the paper gripper 6 moves via the lower rails 10 towards the stack 12 and enters between the lifted printing plate 14 and the interleave paper.

Figure 4:
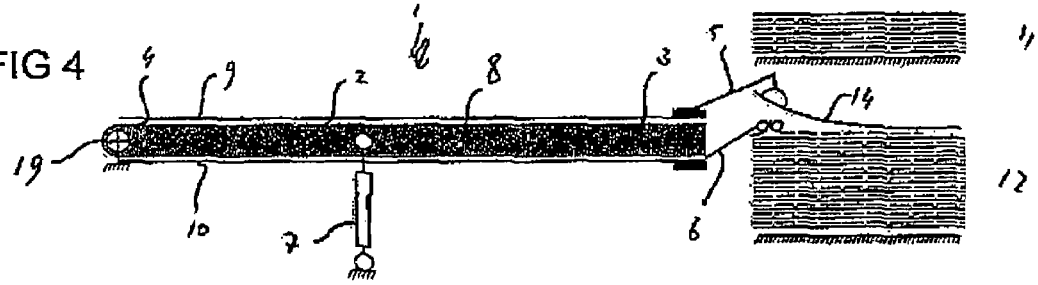
FIG. 4 shows a schematic side view of the imaging system of FIG. 1 during a third stage of a loading process.

During a third stage of the loading process, as shown in FIG. 4, the paper gripper 6 engages the interleaving paper and holds it in place.

Figure 5:
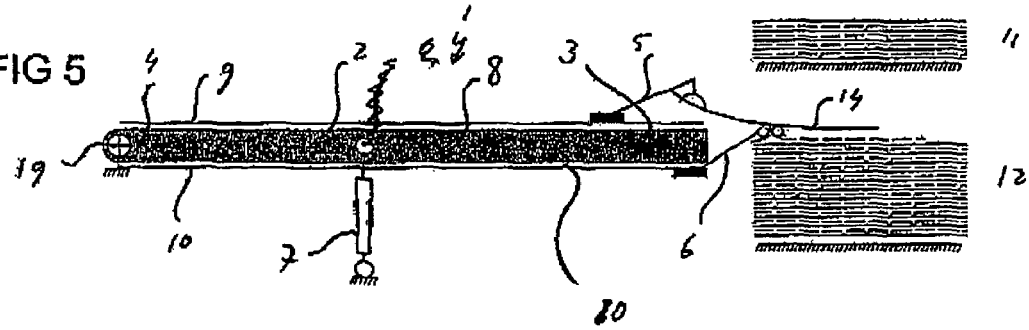
FIG. 5 shows a schematic side view of the imaging system of FIG. 1 during a fourth stage of a loading process.

During a fourth stage of the loading process, as shown in FIG. 5, the printing plate loader 5 pulls the printing plate 14 from the stack 12.

Figure 6:
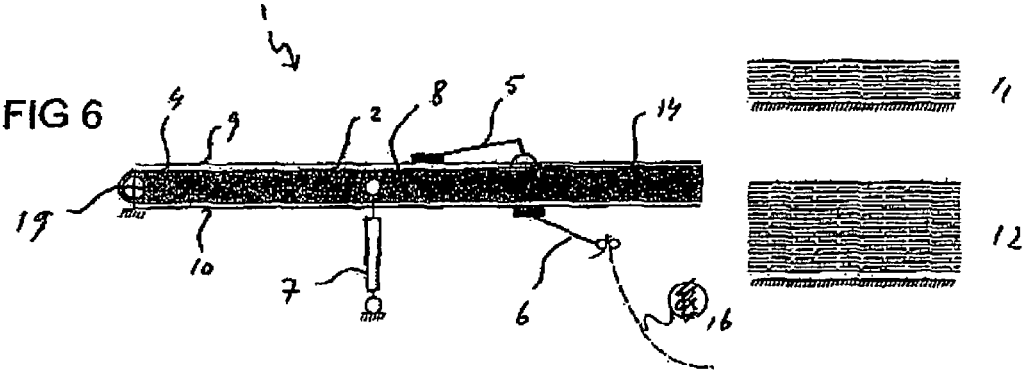
FIG. 6 shows a schematic side view of the imaging system of FIG. 1 during a fifth stage of a loading process.

During a fifth stage of the loading process, as shown in FIG. 6, the printing plate loader 5 drops the printing plate 14 at the input section 3 of the plate bed 2, as the printing plate loader 5 is positioned above the bed 2. The paper gripper 6 pulls the interleaving paper 16 from the stack 12.

Figure 7:
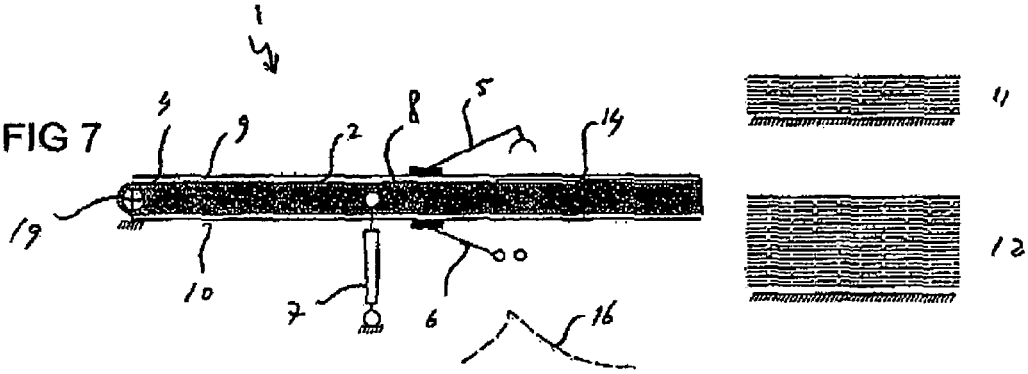
FIG. 7 shows a schematic side view of the imaging system of FIG. 1 during a sixth stage of a loading process.

During a sixth stage of the loading process, as shown in FIG. 7, the printing plate loader 5 moves to a rest position, while the paper gripper 6 drops the interleaving paper 16 which then falls downwards under the bed 2, as the paper gripper 6 is localized under the bed 2.

Figure 8:
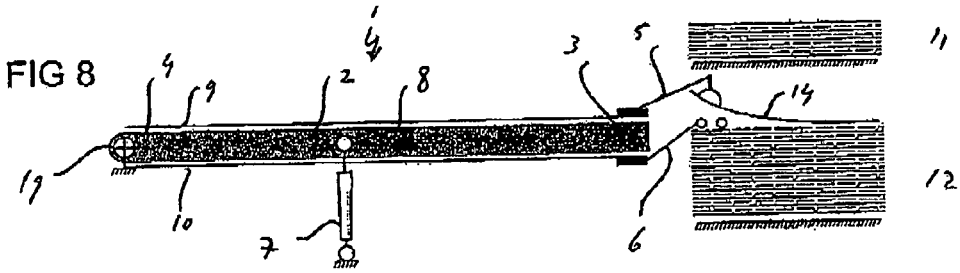
FIG. 8 shows a schematic side view of the imaging system of FIG. 1 during a loading process from a full stack.
Figure 9:
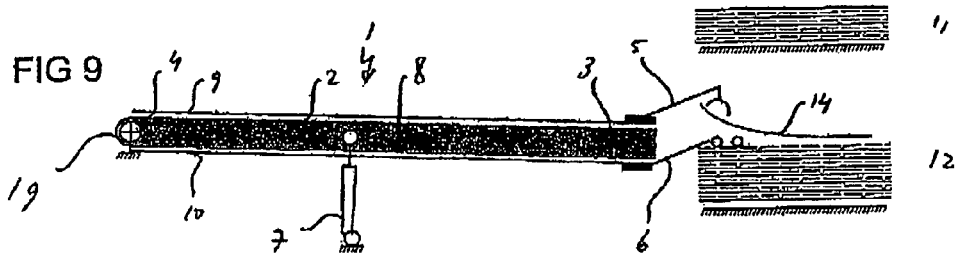
FIG. 9 shows a schematic side view of the imaging system of FIG. 1 during a loading process from a half full stack.
Figure 10:
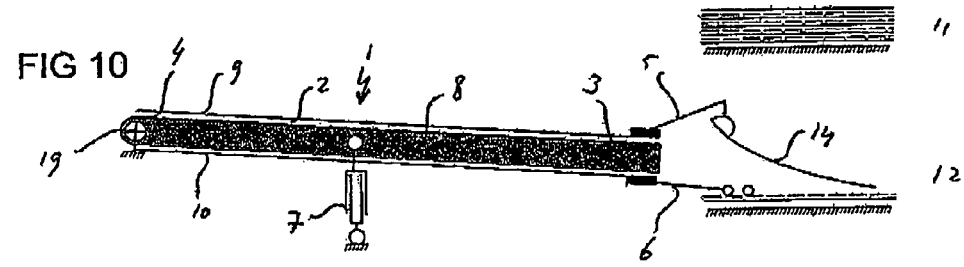
FIG. 10 shows a schematic side view of the imaging system of FIG. 1 during a loading process from an almost empty stack.

In FIGS. 8-10, a schematic side view of the imaging system 1 is shown during a loading process from a full stack 12, a half full stack 12 and an almost empty stack 12, respectively. As can be seen in the FIGS. 8-10, the actuator mechanism 7 adjusts the pivotal orientation of the bed 2 in such a manner that the input section 3 of the bed approaches the top of the stack 12 to be unloaded. In this way, the input section 3 follows the reducing top of the stack 12.

Figure 11:
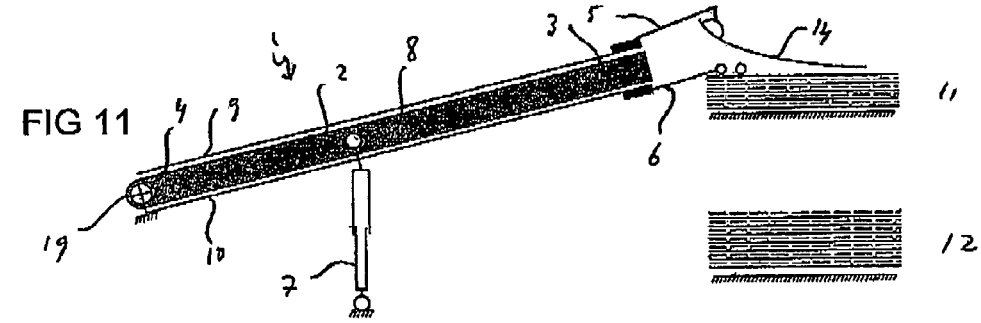
FIG. 11 shows a schematic side view of the imaging system of FIG. 1 during a loading process from a second stack.

Further, FIG. 11 shows a schematic side view of the imaging system 1 during a loading process from a second stack 11. The second stack 11 is placed at a higher position than the first stack 12. Therefore, beginning from the situation as shown in FIG. 9, the input section 3 of the bed 2 is moved upwards by means of the actuator mechanism 7 until the top level of the second stack 11 is reached and the loading process can start.

The invention is not restricted to the embodiments described herein. It will be understood that many variants are possible.

Instead of using a polygon laser module, alternative exposure systems for irradiating the radiation sensitive surface of the printing plate such as imaging arrays or galvo-resonator based scanning laser beam modulators can be employed.

Further, the whole configuration of the stacks and the imaging system can be pivoted, e.g. to obtain a system wherein the printing plates are oriented in a substantial vertical direction.

Other such variants will be obvious for the person skilled in the art and are considered to lie within the scope of the invention as formulated in the following claims.

The invention claimed is:

1. An imaging system for performing a computer-to-plate imaging process on printing plates, comprising:

a plate imaging bed for exposing radiation to a printing plate, the plate imaging bed being provided with an input section for receiving a printing plate from a multiple plate stack and an output section for transferring the printing plate to a processing unit, said plate imaging bed being pivotable about a pivoting axis to adjust a position of the input section relative to the output section; and a loading device for loading the printing plate from the multiple plate stack to the input section of the plate imaging bed, wherein the input section of the plate imaging bed is adjustable with respect to the output section to adjust the position of the input section to near the top of the multiple plate stack by pivoting the plate imaging bed about the pivoting axis.

2. An imaging system according to claim 1, wherein the pivoting axle is arranged near the output section.

3. An imaging system according to claim 1 wherein the plate imaging bed forms a stiff lever arm.

4. An imaging system according to claim 1, comprising a position adjusting device engaging the plate imaging bed remote from the pivoting axle for positioning the input section near the top of the multiple plate stack.

5. An imaging system according to claim 4 wherein the position adjusting device comprises an actuator mechanism.

6. An imaging system according to claim 1, wherein the loading device comprises a printing plate loader and a paper gripper.

7. An imaging system according to claim 6, wherein the printing plate loader and/or the paper gripper are movable along the plate imaging bed between the input section and the output section.

8. An imaging system according to claim 6, wherein the printing plate loader comprises a vacuum loader.

9. A method for loading a printing plate from a multiple plate stack to an input section of a plate imaging bed in an imaging system as claimed in claim 1 for performing a computer-to-plate imaging process on printing plates, the method comprising adjusting the position of the input section to near the top of the multiple plate stack.

10. A method according to claim 9, further comprising gripping an interleave paper that is positioned between subsequent printing plates.

11. An imaging system for performing a computer-to-plate imaging process on printing plates, comprising:

a plate imaging bed for exposing radiation to a printing plate, wherein the plate imaging bed forms a stiff lever arm, the bed being provided with an input section for receiving a printing plate, an output section for transferring the printing plate to a processing unit, the plate imaging bed including a pivoting axle arranged near the output section for pivoting the plate imaging bed;

a loading device for loading the printing plate from a multiple plate stack to the input section of the plate imaging bed, wherein the input section is adjustable with respect to the output section to adjust the vertical position of the input section to near the top of the multiple plate stack, the loading device comprising a printing plate loader and a paper gripper, wherein the printing plate loader comprises a vacuum loader; and a position adjusting device engaging the plate imaging bed remote from the pivoting axle for positioning the input section near the top of the multiple plate stack, wherein the position adjusting device comprises an actuator mechanism.

* * * * *

UNITED STATES PATENT AND TRADEMARK OFFICE

CERTIFICATE OF CORRECTION

PATENT NO. : 7,610,854 B2
APPLICATION NO. : 11/542490
DATED : November 3, 2009
INVENTOR(S) : Wattyn It is certified that error appears in the above-identified patent and that said Letters Patent is hereby corrected as shown below:

Column 1, line 48 "art" should be changed to -- an --

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,610,854 B2
APPLICATION NO. : 11/542490
DATED : November 3, 2009
INVENTOR(S) : Bart Marc Luc Wattyn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 257 days.

Signed and Sealed this

Twelfth Day of October, 2010

David J. Kappos

David J. Kappos
*Director of the United States Patent and Trademark Office*